United States Patent [19]

Schaeffer

[11] 4,091,551

[45] May 30, 1978

[54] EXTRA CAPACITY STEAM IRON

[75] Inventor: Robert L. Schaeffer, LeRoy, N.Y.

[73] Assignee: General Electric Company, Bridgeport, Conn.

[21] Appl. No.: 736,381

[22] Filed: Oct. 28, 1976

[51] Int. Cl.[2] ..... D06F 75/16

[52] U.S. Cl. ..... 38/77.83

[58] Field of Search ..... 38/77.5, 77.6, 77.7, 38/77.8, 77.82, 77.83, 77.9

[56] References Cited

U.S. PATENT DOCUMENTS

| | | | |
|---|---|---|---|
| 2,792,652 | 5/1957 | Dawson | 38/77.83 |
| 2,815,592 | 12/1957 | Gomersall | 38/77.83 |
| 2,853,814 | 9/1958 | Brandler et al. | 38/77.83 |
| 3,599,357 | 8/1971 | Gronwick | 38/77.5 |
| 3,711,952 | 1/1973 | Risacher | 38/77.83 |
| 3,828,452 | 8/1974 | Eaton et al. | 38/77.83 |
| 3,919,793 | 11/1975 | Toft | 38/77.83 |

*Primary Examiner*—Patrick D. Lawson
*Attorney, Agent, or Firm*—John F. Cullen; George R. Powers; Leonard J. Platt

[57] ABSTRACT

The invention is directed to an extra capacity steam iron with a soleplate having steam ports and heating means and separate forward main, and rear surge, steam generators with conventional means for selective delivery of water to the generators and having a heat regulating thermostat. The improvement to this structure comprises a walled enclosure on the soleplate defining the surge generator in the rear half of the iron and tortuous passages lead from the enclosure to the soleplate ports. A boss is provided upstanding from the soleplate spacedly disposed in the enclosure and a coverplate defines steam distributing passages from the main generator and, with the enclosure and the passages, separate distributing passages from the surge generator. The upstanding boss is in the form of a pyramid with plural slanted striated surfaces sloping toward the soleplate, the striations being in the form of parallel grooves directed down the surfaces to spread and direct water into the enclosure. The water delivery means dumps water substantially centrally of the boss so that the boss forms a heat sink and a water spreader throughout the walled enclosure for efficient and rapid heat transfer to form extra capacity steam.

6 Claims, 3 Drawing Figures

EXTRA CAPACITY STEAM IRON

BACKGROUND OF THE INVENTION

1. FIELD OF THE INVENTION

The invention herein pertains to an extra capacity steam iron with its surge boiler in the rear of the iron formed of a walled enclosure with a pyramid-shaped upstanding boss in the enclosure formed to provide a good heat sink and water spreader throughout the enclosure for efficient heat transfer to steam.

2. DESCRIPTION OF THE PRIOR ART

Irons having provisions for extra capacity steam on demand are well known. Generally, such irons employ spaced generators with the main generator for the customary steam and a separate spaced generator which, on demand, may receive a separate charge of water to create a quick volume of steam for touch-up or difficult creases. In some, the main flow and surge flow come together to pass through a tortuous or conversion passage together and thence to the soleplate ports as in U.S. Pat. No. 3,599,357; some use a consecutive flow pattern as in U.S. Pat. No. 3,711,972; some provide confluent flows as in U.S. Pat. No. 3,828,452, and some use completely separated flows as in U.S. Pat. No. 3,919,793, of common assignment. All of these prior arrangements have the surge generator substantially centrally of or forward in the iron because all are designed for the normal conventional size larger household irons. Recent developments have produced lightweight, smaller, plastic irons, at a lower price while retaining many of the standard features for dry, steam, and surge operations and these smaller irons have presented problems in applying the usual structure to obtain saisfactory results. A typical iron of this general type is shown in U.S. Pat. No. 3,986,282 of common assignment. This iron uses a rear surge generator and has required a revision in design from the usual larger irons simply because there is not enough room in this small lightweight iron for the usual arrangement of parts to supply the various features. Thus, the main object of the invention is to provide an iron structure for an extra capacity steam iron having a completely different formation of surge generator in order to provide the water spreading characteristics and heat transfer necessary for adequate surge capacity.

DESCRIPTION OF THE PREFERRED EMBODIMENT

Figure 1:
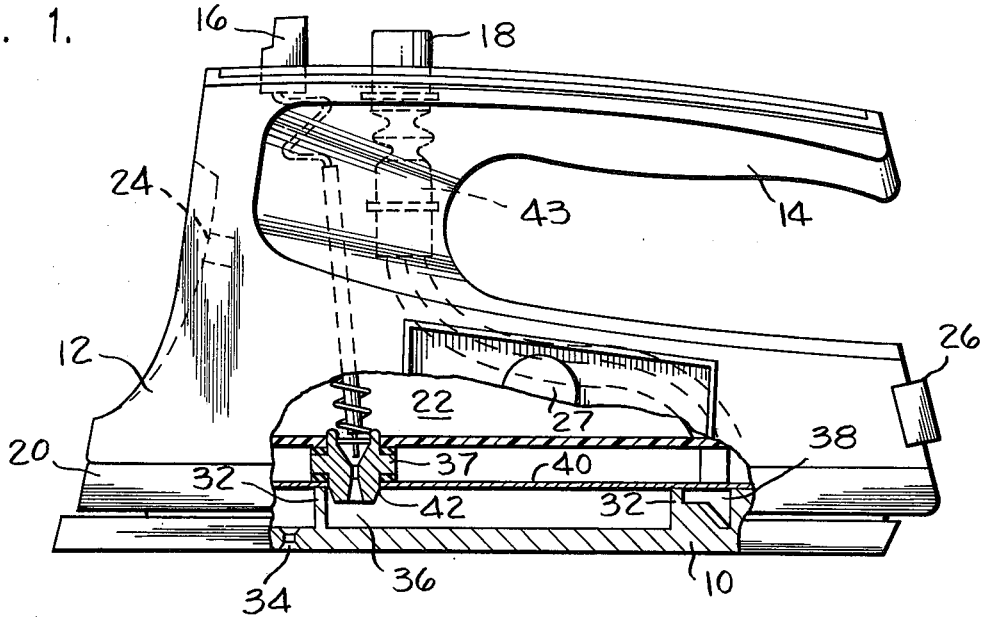
FIG. 1 is an elevation view, partially broken away, illustrating the general arrangement.

Referring to FIG. 1, there is shown a small lightweight plastic iron for steam and extra surge capacity having a soleplate 10 with conventional steam ports, a one-piece molded plastic contoured housing 12 formed with handle 14 and having conventional steam button 16 and extra surge button 18. A separate plastic skirt 20 isolates housing 12 from the hot soleplate 10 and an internal water tank 22 is part of the plastic housing and is filled through the front of the iron at 24. A stabilizing bar 26 steadies the iron in its heel rest position and may be used to wind the electrical cord not shown.

Because of the arrangement of the iron, the conventional forward handle-mounted thermostat or a saddle plate mounted control under handle 14 is difficult because of complex linkage required and the water tank 22 respectively. To overcome these difficulties, a side thermostat button 27 is provided to set the desired iron temperature in a compact arrangement. The avoidance of difficult conventional linkage and use of a simple side thermostat control in such a small iron is the subject of co-pending application Ser. No. 743,680 filed Nov. 22, 1976 of common assignment.

Figure 2:
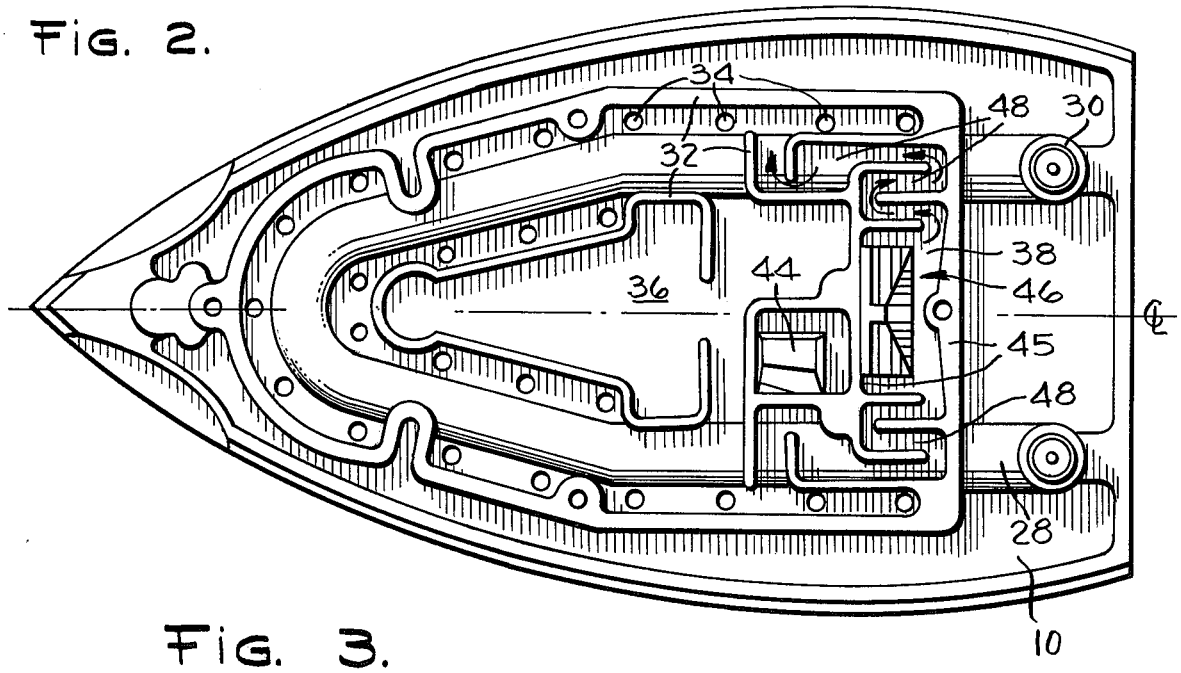
FIG. 2 is a plan view of the soleplate of such iron.

Referring to FIG. 2, the soleplate assembly is shown including aluminum soleplate 10 with a heating means 28 that may form part of the soleplate casting and comprises a continuous rod containing magnesium oxide that loops around the iron generally coming to a point at the nose and having terminal means 30 at the rear for connection to an electric source as is well-known. Also forming part of the soleplate casting is a series of ribs 32 suitably formed for directing steam in a known manner out through soleplate ports 34.

To provide normal steam from the iron, a forward main generator 36 receives water drops at the front as shown through valve assembly 37 when button 16 is in the up position all as shown and as is well-known. The water dropping onto the hot soleplate 10 flashes into steam and the resulting steam is directed by ribs 32 to exit ports 34. For an extra surge of steam, there is provided a rear surge generator 38 disposed in the rear half of the iron, so that, if desired, water may be directed to it in the iron heel rest position to provide steam in the vertical position. If vertical surge is not desired, rear generator 38 is supplied with an extra quantity of water directly into the generator at the rear as shown to generate steam on demand, the steam following the arrows through a tortuous passage around ribs 32 for extra surge from ports 34. Cooperating with ribs 32 and soleplate 10, there is provided a coverplate 40 which defines steam distributing means from both generators 36 and 38. The coverplate 40 has an opening 42 through which the usual water valve structure 37 dispenses water to main generator 36 and the coverplate is sealed to ribs 32 to define the steam distributing means from the generators. A suitable internal pump 43 and water valve structure 37, both individually known in the art, are connected respectively to buttons 16 and 18 to selectively deliver water to the generators 36 and 38. Side thermostat control 27 sets the desired temperature as disclosed in said co-pending application.

Figure 3:
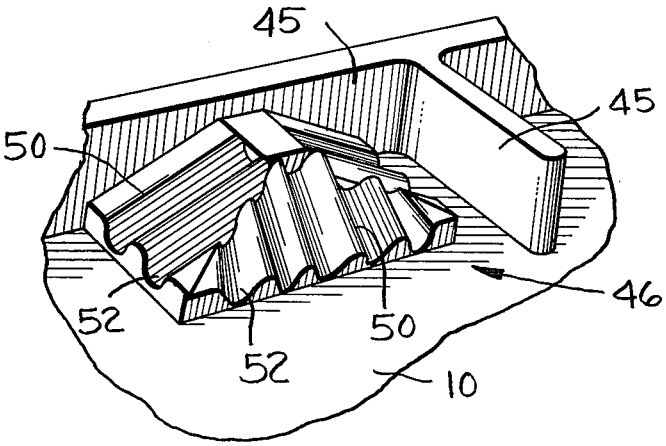
FIG. 3 is a partial perspective view showing the surge generator.

Because of the rearrangement of parts in this small lightweight plastic iron, a different surge generator is required in order to adequately provide the heat necessary for the extra steam on demand and this generator 38, is located in the rear half of the iron so that it is usable in a vertical position if desired, as well as disposing it there for efficient placement in the limited space available to provide supplementary assistance to the normal flat bottom type surge or extra capacity generators. To this end, a particular type thermostat mount 44 is provided as disclosed in said co-pending application Ser. No. 743,680. The rear surge generator 38 does not take heat from the main generator 36 and is desirably close to the thermostat on mount 44. For adequate surge capacity, a walled rear enclosure 45 is disposed rearwardly on the soleplate and defines the surge generator 38 to provide a separate isolated generator. Providing heat sink capabilities and water spreading, the boss 46 is preferably formed integral with and upstanding from the soleplate 10 within the walled enclosure 45 and generally spaced therefrom. For additional steam conversion, a pair of tortuous passage means 48 extend from the enclosure over and along the heating means 28 to the soleplate ports on each side of the soleplate. The top of the various passages is enclosed by coverplate 40 to define steam distributing means from main generator 36 to the soleplate ports around the ribs 32 in the customary manner, and the coverplate also covers rear walled enclosure 45 and passages 48 separately from the surge generator 38 so that water directed into each of the generators is converted into steam and follows separate passages to the ports 34. Because of the smaller overall size of the iron and the limited space for the usual components, the surge capacity is enhanced by the use of boss 46 which provides a large heat sink for the water dropping thereon. To increase the heat sink capacity, the boss is formed generally in the shape of a pyramid, as seen in FIG. 3 with plural slanted surface means 50 sloping toward the soleplate 10 so that water dropped on the apex of the pyramid is spread and directed throughout the enclosure 45 onto the hot soleplate 10. As seen in FIG. 2, the boss 46 is disposed on the longitudinal centerline of the soleplate so suitable pump 43 directs the water substantially centrally of the apex of the boss as seen in FIG. 1. For better heat transfer, each slanted surface of the pyramid boss 50 includes striations in the form of parallel grooves 52 of any suitable number with each groove being directed down the surface to the soleplate to provide a larger area of heat transfer and to direct all the water directly into the enclosure 45. To supply improved reaction to thermostat 44, the pyramid boss 46 has its back side abutting the back wall of the enclosure as seen in FIG. 3 providing a large heat transfer surface directly into the abutting wall 45. Any suitable number of grooves 52 may be used since any form of striation will increase the heat transfer surface of the boss but the preferred parallel groove form is effective. Thus, the invention provides an arrangement that may be used in a small lightweight plastic iron with the surge boiler in the rear so that it does not affect normal steam generation but adequately provides an extra surge of steam on demand. In this combination, the enclosed pyramid-shaped mass of boss 46 improves the performance of the surge of steam feature. The striated pyramid spreads and disperses the water pumped in so that it is converted to steam more quickly and efficiently. The grooved surfaces directed to the soleplate provide a larger surface area and direct dispersion of the water into the walled enclosure as it flows over the pyramid surface. Thus, in addition to providing more heat, the additional mass of the upstanding boss, the pyramid shape and striated surface all accelerate the conversion of water into steam in a small iron.

While I have hereinbefore shown a preferred form of the invention, obvious equivalent variations are possible in light of the above teachings. It is therefore to be understood that, within the scope of the appended claims, the invention may be practiced otherwise than as specifically described, and the claims are intended to cover such equivalent variations.

I claim:

1. An extra capacity steam iron having a soleplate with steam ports and heating means with separate forward, main, and rear surge steam generators, means to selectively deliver water at the front and rear to the respective isolated generators, and heat regulating thermostat means, the improvement comprising:

a walled rear enclosure on the soleplate defining the separate isolated surge generator;

tortuous passage means from said rear enclosure to the ports;

a boss integral with and upstanding from the soleplate spacedly disposed in the enclosure;

a coverplate defining steam distributing means from the main generator and, with said enclosure and passage means, defining steam distributing means separately from said isolated surge generator;

said boss having plural slanted surface means sloping toward the soleplate;

said delivery means directing water substantially centrally of the boss;

whereby the boss forms a heat sink and water spreader throughout the enclosure for heat transfer to steam.

2. Apparatus as described in claim 1 wherein plural tortuous passage means is provided extending from said walled enclosure over said heating means to each side of the soleplate.

3. Apparatus as described in claim 1 wherein said slanted surface means on said boss are striated to increase the heat transfer surface area.

4. Apparatus as described in claim 3 wherein said boss is disposed on the longitudinal centerline of the soleplate and is formed in the shape of a pyramid.

5. Apparatus as described in claim 4 wherein said pyramid has one side abutting said enclosure, and each slanted surface means includes parallel grooves thereon, said grooves directed down the surfaces to the soleplate to spread and direct water into the enclosure.

6. Apparatus as described in claim 5 wherein said pyramid boss is disposed on the longitudinal centerline of the soleplate, and plural tortuous passage means is provided extending from said enclosure over said heating means to each side of the soleplate.

* * * * *